US006508184B1

(12) United States Patent
Winter et al.

(10) Patent No.: US 6,508,184 B1
(45) Date of Patent: Jan. 21, 2003

(54) LIGHTWEIGHT FOLDING TABLE WITH SELF-FIXTURING LEG ATTACHMENT

(75) Inventors: Preston Winter, Morgan, UT (US); Curtis L. Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 09/769,678

(22) Filed: Jan. 25, 2001

(51) Int. Cl.[7] ..... A47B 3/00

(52) U.S. Cl. ..... 108/125; 108/129; 108/156; 248/188.1

(58) Field of Search ..... 248/188.1; 108/121, 108/125, 127, 129, 156, 160, 901

(56) References Cited

U.S. PATENT DOCUMENTS

| | | | | | |
|---|---|---|---|---|---|
| 1,987,767 | A | * | 1/1935 | Beiger | |
| 2,054,755 | A | * | 9/1936 | Kovats | |
| 2,681,841 | A | * | 6/1954 | Sperry | |
| 3,329,383 | A | * | 7/1967 | Pilliod et al. | 56/364 |
| 4,043,277 | A | | 8/1977 | Wallace | 108/35 |
| 4,084,517 | A | | 4/1978 | Guess | 108/153 |
| 4,603,642 | A | | 8/1986 | Brickman | 108/25 |
| 4,951,576 | A | * | 8/1990 | Cobos et al. | 108/131 |
| 5,505,142 | A | | 4/1996 | Fink | 108/129 |
| 5,711,572 | A | | 1/1998 | Khan | 297/140 |
| 5,732,637 | A | * | 3/1998 | Raab | |
| 5,983,807 | A | | 11/1999 | Tarnay et al. | |
| 6,000,346 | A | | 12/1999 | Pajerski et al. | 108/158.1 |

* cited by examiner

*Primary Examiner*—Janet M. Wilkens
(74) *Attorney, Agent, or Firm*—Workman, Nydegger & Seeley

(57) ABSTRACT

A lightweight folding table with legs that may be attached without a separate fixturing step is disclosed. Preferably, the table includes a table top having a working surface and a mounting surface, upon which the legs are attached. Fixturing mounts may be integrally formed with the table top by a process such as blow molding. The fixturing mounts may be configured to receive and hold independent mounting assemblies, each of which is pivotally attached to a leg. The fixturing mounts may have fixturing protrusions arranged so as to frictionally engage the mounting assemblies in such a manner that the mounting assemblies are held in place. An adhesive may then be applied to the mounting assemblies to provide a more permanent attachment, if desired. The adhesive may be allowed to set without using any external fixturing implements to hold the mounting assemblies in place.

52 Claims, 5 Drawing Sheets

LIGHTWEIGHT FOLDING TABLE WITH SELF-FIXTURING LEG ATTACHMENT

BACKGROUND

1. The Field of the Invention

The present invention is related to a utility table, and more particularly, to a lightweight folding table having legs attached in self-fixturing fashion.

2. Technical Background

Lightweight folding tables are indispensable for groups or organizations that have limited floor space usable for multiple purposes. For example, foldable utility tables can be placed in a pre-determined configuration to meet the space requirements of a school or community gymnasium, a church multi-purpose room, or a hotel conference meeting room. Afterward, the tables can be neatly stored away and the room used for a different purpose. Thus, lightweight folding tables allow a group or organization to maximize the efficiency and utility of a particular space.

Foldable utility tables can also provide an immediate temporary work space in a garage, tool shed, and the like. The portability and foldability of these utility tables allows a user to conveniently set up, take down, and store the table whenever and wherever the user chooses.

A major drawback with many lightweight folding tables of the prior art is their inherent size and bulkiness. Many such utility tables require two people to collapse and store the table after use. Moreover, some prior art lightweight folding tables are heavy enough to cause injury if dropped or mishandled. These unwieldy tables are usually made from hardwood, particle board, or similarly heavy materials. In an attempt to overcome this bulkiness problem, some prior art portable utility tables are formed of lighter-weight materials. However, many of these utility tables generally lack the sturdiness of the heavier-weight prior art utility tables.

Another disadvantage to many prior art utility tables is the means used for attaching the table legs or two or more support pedestals to the underside of the table. As will be appreciated, prior art table legs are typically attached to the table top using mechanical fasteners, such as threaded screws or bolts, that are drilled into the underside of the table top. This means of attachment may compromise the integrity of the table top, thereby making it weaker at the point of attachment between the table legs and the table top.

Weakening of the table top material is especially problematic if lightweight materials are used to construct the tabletop. If legs are independently attached, as with smaller folding tables such as card tables, the danger of deflection of the table top may be increased because each leg is subject to lateral, or sideways, forces in multiple directions. With smaller tables, members used to attach the legs to the table top must also be compact, and thus may not effectively spread forces against the leg over a large region of the table top. In effect, forces against a leg are concentrated in the small region where the leg and any attachment members are affixed to the table top. As a result, the table top may bend, or the leg may become dislodged from the attachment members.

Many lightweight prior art tables compensate for the weakness of the lightweight table top material by adding a frame of stronger material underneath the table top. Such frames are typically made of metal, and add considerably to the weight of the table, to the extent that the table may no longer reasonably be classified as a lightweight table.

Furthermore, additional parts are required to attach the frame to the table top. Tables with separate frames typically have legs that are not independently attached. In effect, the legs are attached to a separate, common member, such as the frame, which is then attached to the table top. Hence, extra steps are required to attach the legs to the table top.

In addition, mechanical fasteners tend to increase the number of parts required for a table. If any significant amount of friction is anticipated between a metal fastener and a plastic part, a bushing, bearing, or similar device must be used to insulate the plastic part from wear. Thus, it is especially desirable to avoid the use of mechanical fasteners between metal and plastic parts.

Prior art methods for attaching legs typically also require several steps to complete the attachment. For example, with many prior art tables, each leg must first be positioned against the underside of the table. Then, the leg must be fixtured, or held in proper alignment with the contact surface on the table top while fasteners are applied.

Fixturing often involves the use of multiple machines, in the case of an automated process, because one machine must hold the leg and the table top together, while another machine completes the fastening process. In the case of human assembly, one person must often keep the leg and table top together while another applies the fastening method. If a single person holds the leg and table top together, he or she must attach the table top and leg together while holding them. Such a process is often difficult to carry out rapidly without making errors. Alternatively, extra implements, such as clamps, clips, temporary mechanical fasteners, and the like may be applied prior to fastening and then removed once fastening has been carried out.

The need to fixture the table and legs adds dramatically to the time required to assemble the table, as well as the amount of equipment and employees needed. Fixturing is especially problematic when mechanical fasteners are used, because mating surfaces, such as bolts, threaded openings, and the like must be precisely aligned. Added steps in the assembly process also increase the chances that a mistake will be made, and the table improperly constructed.

From the foregoing, it will be appreciated that it would be an advancement in the art to provide a lightweight folding table that is durable enough to withstand the increased wear and tear that portable utility tables are subjected to over long periods of time and sturdy enough to support varying sized loads that will be place on the table, while at the same time being light-weight enough to be easily set up and taken down.

It would be another advancement in the art to provide a lightweight folding table that does not require extra process steps, machinery, or personnel to carry out fixturing of the legs to the table top for attachment. It would be a further advancement in the art to provide a lightweight folding table having a leg or support pedestal attachment mechanism that does not require any mechanical fasteners attached to the table top.

Yet further, it would be an advancement in the art to provide a method and apparatus for attaching legs to a table top that would not require occupation of a great deal of mounting space, and that would permit independent attachment and folding of the legs. The method and apparatus could then be effectively used with smaller tables, such as card tables.

Such a lightweight folding table is disclosed and claimed herein.

BRIEF SUMMARY OF THE INVENTION

The present invention is directed to a novel lightweight folding table having legs that are independently attached to a table top, preferably without the use of a frame or any additional mechanical fasteners. The table top maybe constructed of a lightweight material, such as a plastic, and may be made from an inexpensive and rapid process, such as blow molding. In one presently preferred embodiment, the table top includes a mounting surface and a working surface formed opposite the mounting surface. Preferably, each leg is pivotally mounted on the table top so that the legs may be folded against the table top for storage and transportation of the table. Each leg may fold in a different direction so that no two legs overlap.

Brackets may be provided to attach the legs to the table top. More specifically, each leg may be pivotally attached to a bracket, and each bracket may, in turn, be rigidly affixed to the mounting surface. The brackets are preferably made from a comparatively stiff, strong material, such as a metal. Preferably, the brackets are shaped to distribute lateral stresses against the legs over a comparatively large portion of the mounting surface, so that deflection of the table top does not occur.

Other members may be attached between the brackets and the legs to provide additional stability and locking in the unfolded and/or folded positions. For example, a slotted member and a support strut may be attached between the leg and the bracket. A knob, wingnut, or other similar tightening device may be threaded through the slot and a suitable opening in the leg to enable a user to lock the leg in a desired orientation.

A fixturing mount is preferably formed in the mounting surface for each bracket. The fixturing mount may include one or more fixturing protrusions, formed integrally with the table top, that are positioned to keep the bracket in place. For example, a mounting shelf may enclose all of the legs, and may form a fixturing protrusion in all of the fixturing mounts. Each fixturing mount may also have additional fixturing protrusions in the form of a first abutment positioned to restrict motion of the bracket in one lateral direction (a direction parallel to the table top) and a second abutment positioned to restrict motion of the bracket in a second lateral direction.

Other fixturing protrusions outside the fixturing mounts may also be used. For example, an upraised portion, in the form of a centrally located plateau, may be formed on the mounting surface. Each leg may be arranged so as to lay flat against one side of the plateau when the table is in the folded configuration. A securing member may be formed near each side of the plateau, so that each folded leg is engaged between the plateau and a securing member.

The fixturing protrusions may thus provide an effective guide for assembly of the brackets with the table top. Furthermore, the fixturing protrusions may be configured to fixture the brackets to the mounting surface for attachment. For example, the abutments may be formed in close proximity to the mounting shelf so that the bracket is held between the abutments and the mounting shelfby friction. Similarly, the securing members mayhold the legs against the plateau. Thus, the brackets may be effectively held in place once they are assembled, so that no additional fixturing steps need be taken. Recesses may also be formed in the mounting shelf with gaps designed to engage tabs protruding from the brackets, to provide additional holding or fixturing force. The brackets may then be attached to the mounting surface by any chosen method.

The fixturing provided by the fixturing protrusions is ideal for use with adhesive attachment, because the adhesive may be allowed to set with no further necessary steps. Thus, although the present invention may provide fixturing for mechanical fasteners, the fixturing action of the present invention provides unique benefits when used with an adhesive. Additional features may be used to facilitate application and setting of the adhesive. For example, slots may be formed in the fixturing protrusions to accommodate the adhesive and hold it next to the brackets, so that a tighter bond is formed.

From the foregoing, it will be appreciated that the present invention provides a lightweight folding table that is inexpensive and easy to manufacture, and yet lightweight and durable. The present invention also provides a method of attaching independent legs to a table top through the use of self-fixturing retaining structures, or fixturing mounts. The fixturing mounts help reduce the time, machinery, and personnel required for assembly of a table.

Furthermore, the table top design of the present invention permits effective use of adhesives to replace conventional mechanical fasteners, so that the part count and assembly time are further reduced. The present invention facilitates independent attachment of the legs so that smaller tables may be easily produced without sacrificing sturdiness. The foregoing and other advantages and features of the present invention will become more filly apparent by examination of the following description of the presently preferred embodiments and appended claims, taken in conjunction with the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
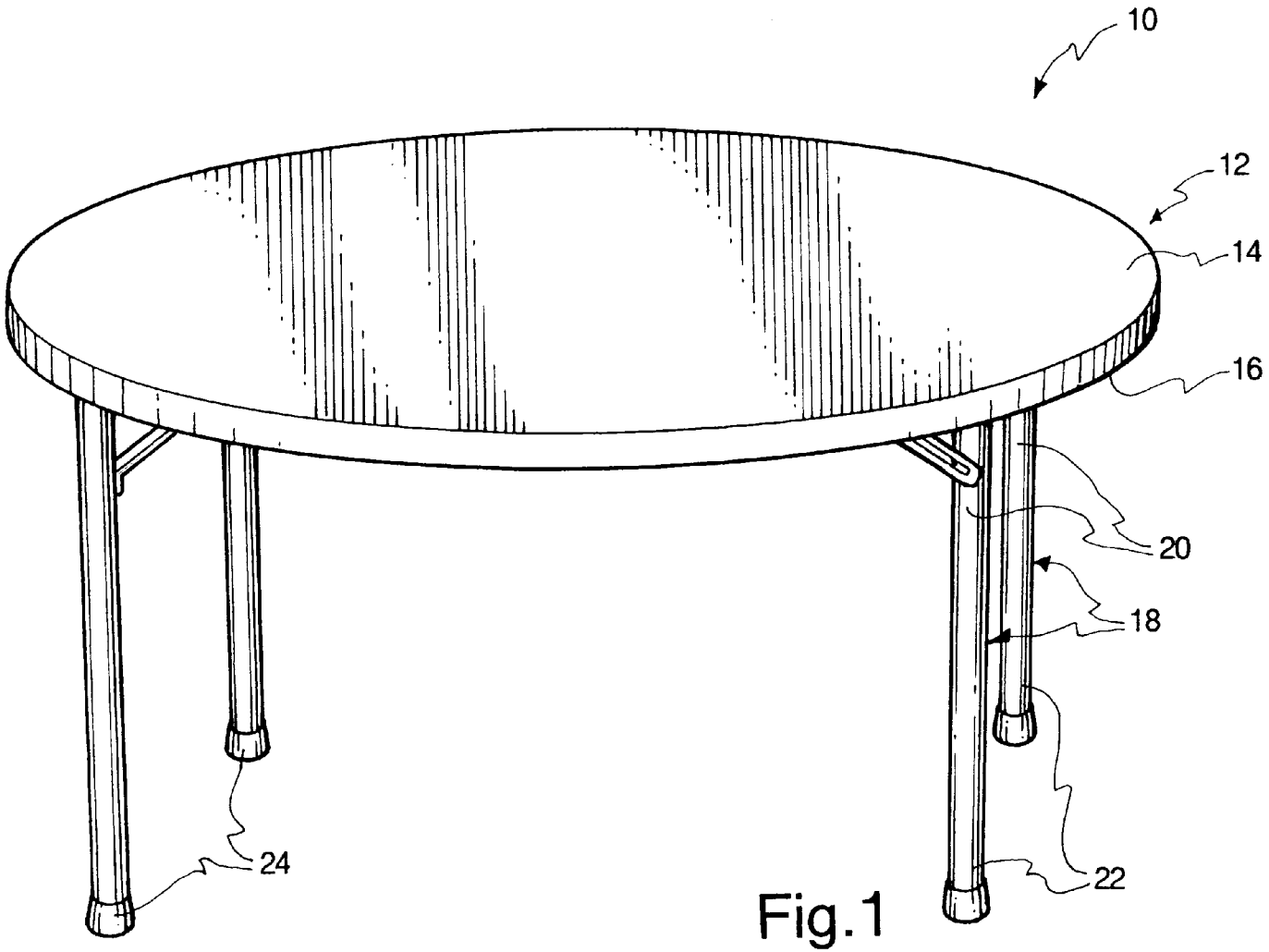
FIG. 1 is a perspective view of one presently preferred embodiment of a lightweight folding table with independently attached legs.

Reference is now made to the figures wherein like parts are referred to by like numerals throughout. With particular reference to FIG. 1, a lightweight folding table according to the present invention is generally designated at 10. Although the method and apparatus of the present invention maybe beneficially utilized with a long, narrow table with linked or unitary sets of legs, particular application is envisioned for a smaller table with independently attached legs, as depicted in FIG. 1.

A table top 12 of the table 10 is preferably situated at a height suitable for use by a person, and may have a working surface 14 suitable for use and a mounting surface 16 upon which legs 18 and their associated supports may be mounted. The working surface 14 may be textured, beveled, or otherwise formed to provide attractiveness and comfortable, easy use by a user. The table top 12 may be constructed of any suitable material, and may be made through any number of manufacturing processes. Preferably, the table top 12 is made from a lightweight material such as plastic, and is made through a simple process such as blow molding.

Through blow molding, the table top 12 may be made substantially hollow, such that structural strength is substantially retained while less material is used. A "substantially hollow" member is a member having an interior cavity occupying a majority of any major cross-section of the member, i.e., a cross-section through more than just a small corner of the member.

The legs 18 may be disposed perpendicular to the table top 12 to maintain the table top 12 at the proper height when the table 10 is in the unfolded configuration. Preferably, the legs 18 are made from a comparatively stiff material, such as a metal. The legs 18 may also be made hollow so as to retain structural strength while requiring less material and weight. Each of the legs 18 may have a proximal end 20 and a distal end 22. Feet 24 may be attached at the distal ends 22 of the legs 18 to broaden the surface over which the weight of the table 10 rests and avoid damaging flooring underneath the table 10. The feet 24 may thus be made of a comparatively soft material, such as a plastic or rubber.

Although the table 10 of FIG. 1 has four legs 18, any suitable number of legs 18 may be included, as suited to the geometry and normal use of the table 10. The apparatus and method of the present invention provides special advantages for tables for which it is desirable to attach and fold each leg independently, such as card tables, folding dining tables, and similar circular or square-shaped tables.

Figure 2:
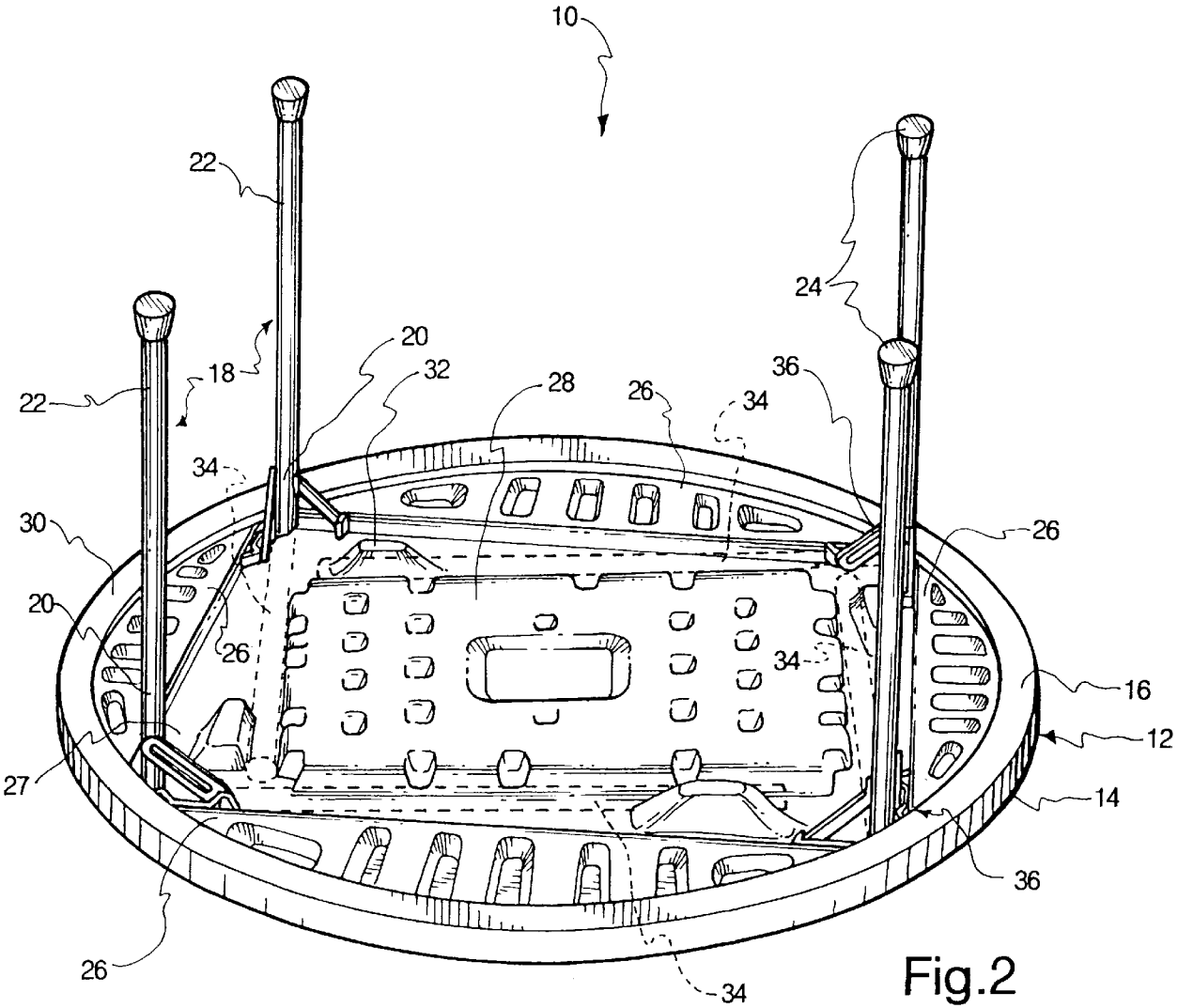
FIG. 2 is a perspective view of the lightweight folding table of FIG. 1, depicting the mounting surface of the table top with attached mounting assemblies to hold the legs in place.

Referring to FIG. 2, the mounting surface 16 of the table top 12 is shown. A mounting shelf 26 may be formed about the periphery of the mounting surface 16. As depicted in FIG. 2, the mounting shelf 26 is simply a substantially vertical, inward-facing wall against which various components may be mounted. The mounting shelf 26 thus restricts motion of any part resting against it in an outward direction. Although the mounting shelf 26 is depicted as square in shape, it may take any straight-sided or curved shape desired. The mounting shelf 26 is preferably integrally formed with the mounting surface 16. Other features may also be formed in the mounting surface 16 to restrict inward motion of parts attached to the mounting surface 16. Examples of such features will be depicted in connection with subsequent figures.

The upraised nature of the mounting shelf 26 may create an indentation 27 inside the mounting shelf 26, into which the legs 18 may compactly fold. A plateau 28 may be formed centrally within the indentation 27, and may be substantially square in shape, as depicted in FIG. 2. The plateau 28 may provide additional structural strength and stiffness for the center of the table top 12, and may also provide a suitable barrier for registering other components of the table. Similarly, an outer edge 30 of the table top 12 may also be upraised to provide strength, stiffness, and comfort for a user of the table 10.

Securing members 32 may also be formed in the mounting surface 16, within the indentation 27. Preferably, the securing members 32 are situated near the plateau 28 so as to act as a clamping mechanism for the legs 18. The legs 18 may then be folded into engagement with the plateau 28 and the securing members 32 to reach a folded position 34, shown in phantom. Each of the securing members 32 may have a lip (not shown) extending over the legs 18 in the folded position 34 to hold them in place. Alternatively, the securing members 32 may simply be positioned close enough to the plateau 28 that the securing members 32 frictionally engage the legs 18 against the plateau 28.

"Frictional engagement" refers to a method of assembly in which assembled parts are held together by friction. The assembled parts effectively fit tightly enough together that forces of static friction tend resist their disassembly. Little deflection of the assembled parts need occur to produce frictional engagement.

Each of the legs 18 may be pivotally attached to the mounting surface 16 with a mounting assembly 36. The mounting assemblies 36 are preferably oriented such that the legs 18 fold into the position 34 depicted in FIG. 2, i.e., parallel to the edges of the plateau 28. The legs 18 may thus fold at an angle with respect to the flat sides of the mounting shelf 26. Alternatively, the legs 18 may be made to fold against the mounting shelf 26, and the securing members 32 may be positioned to secure the legs 18 against the mounting shelf 26 in the folded configuration.

Figure 3:
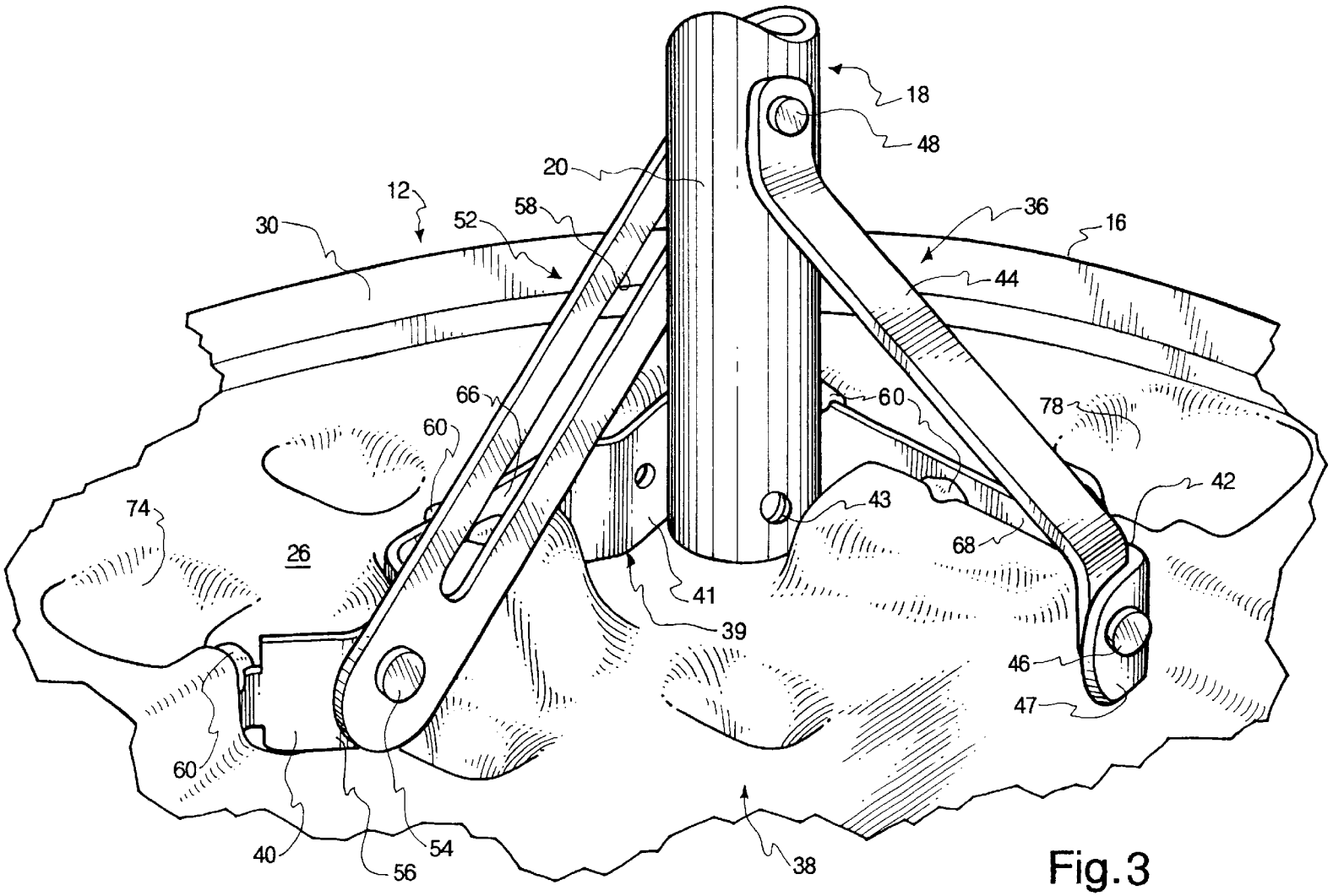
FIG. 3 is an enlarged perspective view of a mounting assembly suitable for the embodiment of FIG. 1, with an associated fixturing mount formed in the mounting surface of the table top.

Referring to FIG. 3, one possible mounting assembly 36 suitable for the table 10 is depicted. Preferably, a fixturing mount 38 is formed in the mounting surface 16. The fixturing mount 38 is simply some portion of the mounting surface 16 with a geometry suitable for receiving and retaining the mounting assembly 36. Preferably, the fixturing mount 38 includes upraised portions of the mounting surface 16 that serve to restrict motion of the mounting assembly 36 in a lateral direction, i.e., parallel to the table top 12.

The mounting assembly 36 may comprise a number of members configured to hold one of the legs 18 in place, while permitting the leg 18 to fold as desired. A bracket 39 of the mounting assembly 36 may abut the mounting shelf 26, and may be held in place by the fixturing mount 38. The bracket 39 may be substantially L-shaped so as to conform to a corner of the mounting shelf 26. The bracket 39 may have a first end 40, an intermediate portion 41, and a second end 42.

Preferably, the bracket 39 is thin, so as to be lightweight, but tall enough to have a high stiffness against bending in a vertical direction. The bracket 39 is preferably sufficiently long, to distribute the pressure of the leg 18 relatively evenly along the mounting surface 16. The bracket is preferably formed of a substantially stiff and strong material, such as a metal. A "substantially stiff" material is a material having a comparatively high modulus of elasticity, i.e., higher than most lightweight materials, such as plastics. Preferably, each bracket 39 of the table 10 is independent, i.e., a separate member from the other brackets, so that each bracket 39 may be attached separately and easily.

One of the legs 18 may be pivotally attached to the bracket 39 at a pivot point 43, which may be formed using a suitable fastener such as a bolt, screw, rivet, shaft and locking pin, or the like. A support strut 44 may be connected between the leg 18 and the bracket 39 to provide additional support for the leg 18, particularly in a direction parallel to the second end 42 of the bracket 39. The support strut 44 may be connected to the bracket 39 at a first attachment point 46, which may be formed by a fastener such as that used to form the pivot point 43.

Preferably, the attachment point 46 is located on an extension 47 extending from the second end 42 of the bracket 39 in near-perpendicular fashion, so that the first attachment point 46 is coaxial with the pivot point 43. The support strut 44 may then pivot together with the leg 18 to reach the folded position 34. The support strut 44 may be rigidly attached to the leg 18, near the proximal end 20 of the leg 18, at a second attachment point 48. The second attachment point 48 may also be created by a fastener such as that of the pivot point 43, although the second attachment point 48 need not accommodate pivoting, since the support strut 44 may rotate with the leg 18.

A slotted member 52 may also serve to connect the leg 18 to the bracket 39, and may also enable locking of the leg 18 in a desired configuration. The slotted member 52 maybe pivotally attached to the bracket 39 at a first attachment point 54. The first attachment point 54 is preferably positioned on an offset portion 56 of the bracket 39, so that the slotted member 52 is angled to permit the leg 18 to fold into the folded position 34, which is angled with respect to the mounting shelf 26. Folding the leg 18 to an angled folded position 34 enables the leg 18 to avoid features of the fixturing mount 38 that may otherwise impede folding of the leg 18.

A slot 58 in the slotted member 52 preferably engages a sliding member (not shown) on the second attachment point 48, disposed on the opposite side of the leg 18 from the support strut 44. The sliding member may take any form that provides sliding motion with respect to the slotted member 52. Furthermore, the sliding member may comprise a fastener configured for locking by hand, such as a knob or wingnut. Thus, a user may lock the sliding member to fix the position of the leg 18 with respect to the slotted member 52, thereby locking the leg 18 in the folded or unfolded configuration.

Alternatively, the sliding member may not be configured for tightening and locking by hand. Rather, the slot 58 may be shaped to capture the sliding member when the leg 18 is folded, when the leg 18 is unfolded, or in both configurations. For example, the slot 58 may have a larger opening (not shown) near the leg 18 so that when the leg 18 is fully unfolded, the sliding member falls into the larger opening and remains in place until a user applies pressure against the slotted member 52 to remove the sliding member from the larger opening.

When the leg 18 is locked in the unfolded configuration, as depicted in FIG. 3, the slotted member 52 may provide lateral support similar to that provided by the support strut 44. Since the support strut 44 and the slotted member 52 provide support in substantially perpendicular lateral directions, the support strut 44 and the slotted member 52 combine to completely support the leg 18 against lateral motion.

The bracket 39 may be held in place by an adhesive 60 applied at various strategic points. The adhesive 60 may be of any suitable type, but is preferably a urethane-based substance selected to bond plastic to metal. The function of the adhesive 60 and the operation of the fixturing mounts 38 will now be described in greater detail.

Figure 4:
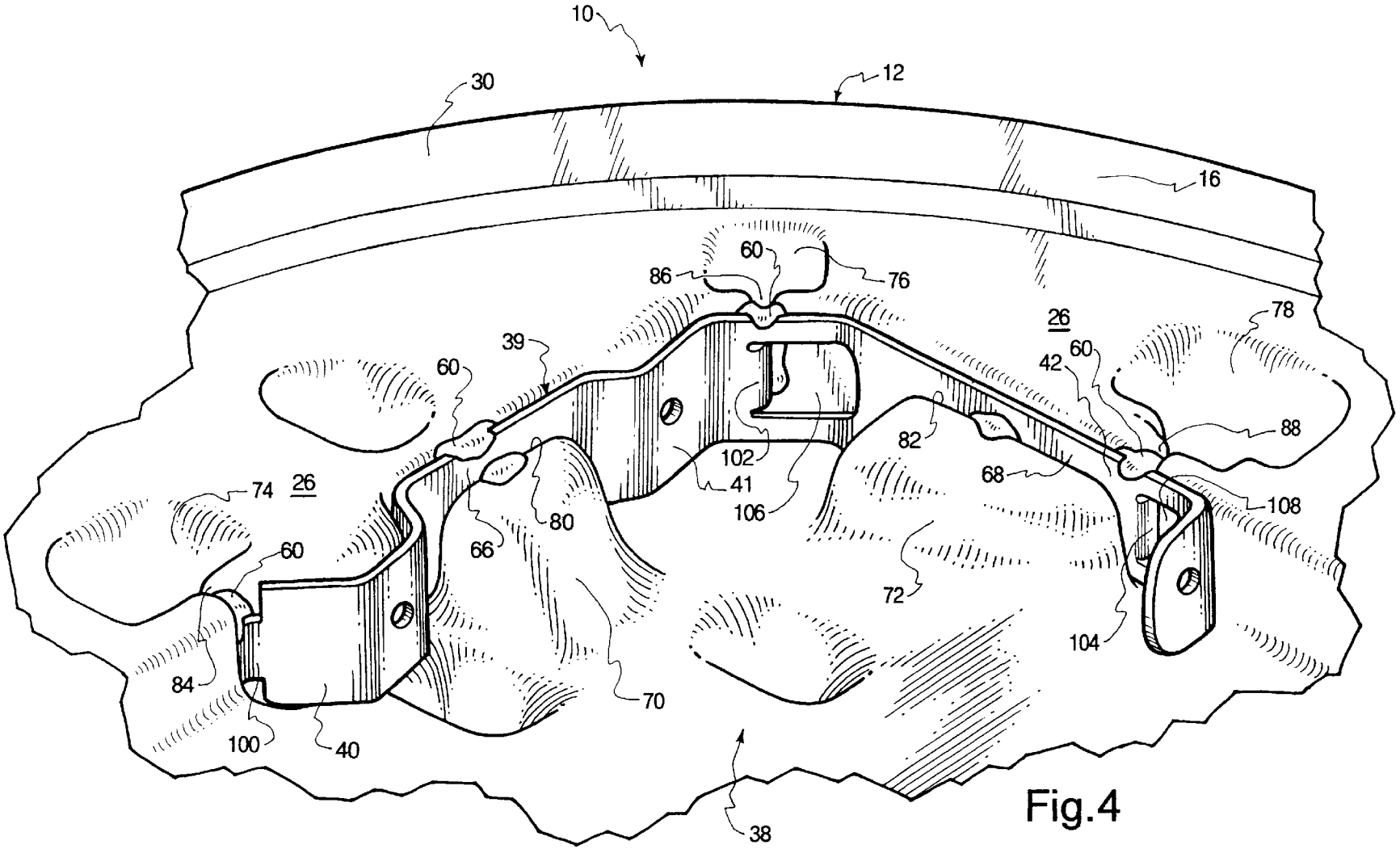
FIG. 4 is an enlarged perspective view of the fixturing mount of FIG. 3 with a bracket of the mounting assembly attached to the fixturing mount by an adhesive and by frictionally engaged tabs protruding from the bracket to corresponding gaps in the fixturing mount.

Referring to FIG. 4, the fixturing mount 38 of FIG. 3 is shown, without the leg 18, support strut 44, slotted member 52, or their associated attachment members 43, 46, 48, and 54. The bracket 39, alone, is installed in the fixturing mount 38. The bracket 39 may generally have a first arm 66 extending between the first end 40 and the intermediate portion 41, and a second arm 68 extending between the intermediate portion 41 and the second end 42.

Preferably, the fixturing mount 38 has a number of features designed to help retain the bracket 39. For example, a first abutment 70 and a second abutment 72 may be positioned in close proximity to the mounting shelf 26. A first recess 74, a second recess 76, and a third recess 78 may also be formed directly in the mounting shelf 26. Such features may be easily created through blow molding by simply creating opposing protrusions and recesses in the mold prior to the blow molding operation.

The first abutment 70 may operate with the mounting shelf 26 to create a first channel 80, or a narrow opening between the first abutment 70 and the mounting shelf 26. Similarly, the second abutment 72 and the mounting shelf 26 may be separated by a second channel 82. Preferably, the first and second channels 80, 82 are dimensioned to receive the bracket 39 on either side of the intermediate portion 41.

Preferably, some force must be applied to the bracket 39 to slide the bracket 39 into engagement within the first and second channels 80, 82, so that a frictional engagement is formed. The required force is preferably large enough to keep the bracket 39 firmly seated in the fixturing mount 38 when the table top 12 is moved, but small enough to be applied by hand so that the bracket 39 may be manually inserted, if desired.

The first abutment 70, as depicted in FIG. 4, provides support against motion of the bracket 39 in a direction parallel to the second end 42 of the bracket 39, i.e., a direction perpendicular to the first channel 80. Similarly, the second abutment 72 restrains the bracket 39 against movement in a direction perpendicular to the second channel 82. In effect, since the first and second channels 80, 82 are substantially perpendicular to each other, the first and second abutments 70, 72 are positioned to restrict motion of the bracket 39 in any lateral direction. Motion perpendicular to the mounting surface 16 may only be accomplished by overcoming the frictional engagement of the first and second abutments 70, 72.

The first recess 74, the second recess 76, and the third recess 78 may have a first gap 84, a second gap 86, and a third gap 88, respectively. A first tab 100, a second tab 102, and a third tab 104 may then be inserted into the gaps 84, 86, 88, respectively. The first tab 100, for example, may simply be an extension of the first end 40 of the bracket 39. The second tab 102 may be formed by making three perpendicular cuts in the intermediate portion 41 of the bracket 39 and bending the material between the cuts to a roughly perpendicular angle to the middle portion 41. Thus, an opening 106 is formed, and the second tab 102 may extend from the opening to engage the second gap 86. Similarly, an opening 108 may be formed in the second end 42, and the material bent outward to form the third tab 104, which may then engage the third gap 88.

The gaps 84, 86, 88 and their associated tabs 100, 102, 104 may also act to more firmly seat that the bracket 39 within the fixturing mount 38. Each of the tabs 100, 102, 104 resists bracket motion in a direction perpendicular to itself. Thus, the bracket 39 may be more resistant to lateral motion with the use of the tabs 100, 102, 104. In addition, the gaps 84, 86, 88 and the tabs 100, 102, 104 may be dimensioned to frictionally engage one another, so as to provide resistance against withdrawal of the bracket 39 from the fixturing mount 38 in a direction perpendicular to the mounting surface 16. The tabs 100, 102, 104 may also have curved terminal portions tending to grip interior surfaces of the recesses 74, 76, 78 to further keep the bracket 39 in place.

The securing member 32 that holds the leg 18 attached to the bracket 39 may provide additional support for the bracket 39. In effect, the securing members 32 maintains the leg 18 in one rotational orientation when the leg 18 is in the folded position 34. Consequently, any force tending to rotate the bracket 39 within the plane of the mounting surface 16 will be effectively resisted by the leg 18 because it is secured by the securing member 32. The securing member 32 may also frictionally engage the leg 18 to support the bracket 39 against removal from the fixturing mount 38 in a direction perpendicular to the table top 12.

Assembly of a leg 18 with the table top 12 may then be carried out without any extra process steps, personnel, or equipment to fixture the bracket 39 during attachment. "Fixturing," as used herein, refers to the process of holding two parts together so that they can be more permanently attached. Since the bracket 39 is held comparatively firmly by the fixturing mount 38, the table 10 is effectively "self-fixturing."

Self-fixturing may be provided through the use of fixturing protrusions of the mounting surface 16 that are easily created through processes such as blow molding. The "fixturing protrusions" include any feature formed in the mounting surface 16 that tends to keep a mounting assembly 36 properly positioned for permanent attachment. In the embodiments depicted in FIGS. 2, 3, and 4, the fixturing protrusions include the mounting shelf 26, the plateau 28, the securing members 32, the first abutment 70, and the second abutment 72. In effect, one process step is eliminated through the unique design of the mounting surface 16 including the fixturing protrusions 26, 28, 32, 70, and 72.

Thus, assembly of a leg 18 to the table top 12 may be rapidly and easily carried out. For example, the leg 18, bracket 39, support strut 44, and slotted member 52 may be assembled as depicted in FIG. 3 through the use of the various attachment members 43, 46, 48, and 54 to form the mounting assembly 36. The mounting assembly 36 may then be inserted into the fixturing mount 38 by aligning the bracket 39 with the first and second channels 80, 82 and applying force to the bracket 39 to seat the bracket 39 firmly within the fixturing mount 38.

The mounting assembly 36 may be inserted into the fixturing mount 38 with the leg 18 in the folded or unfolded configuration. If the leg 18 is folded during insertion, the leg 18 may be pushed into engagement with the securing member 32 and the plateau 28 simultaneously with insertion of the mounting assembly 36 into the fixturing mount 38. If the leg 18 is unfolded during insertion, it may subsequently be folded into the folded position 34 to engage the securing member 32 and the plateau 28. In either case, engagement of the leg 18 by the securing member 32 and plateau 28 may help fixture the bracket 39.

After the mounting assembly 36 and the leg 18 are fully engaged, the bracket 39 is fully fixtured and ready for attachment to the mounting surface 16 by any desired method. Preferably, the bracket 39 is attached to the fixturing mount 38. Mechanical fasteners may be utilized if desired. The self-fixturing properties of the bracket 39 and the fixturing mount 38 may facilitate application of mechanical fasteners.

"Mechanical fasteners," as referred to herein, are independent solid devices used to attach two or more parts together. For example, bolts, nuts, screws, clips, clamps, rivets, and pins are all mechanical fasteners. Chemical adhesives, welds, and the like are not mechanical fasteners.

The self-fixturing properties of the table 10 may provide great benefits in combination with adhesive fastening methods. The adhesive 60 maybe applied at any comparatively tight interface between the bracket 39 and the fixturing mount 38. As depicted in FIGS. 3 and 4, the adhesive 60 may, as one example, be applied at the first channel 80, the second channel 82, the first gap 84, the second gap 86, and the third gap 88. Since the bracket 39 and the fixturing mount 38 are comparatively tightly assembled at these points, the adhesive 60 may effectively cap the bracket 39 against withdrawal of the bracket 39 in a direction perpendicular to the table top 12.

The adhesive 60 may be applied by any desired method. If plastic is used to form the table top 12, the plastic of the fixturing mount 38 maybe flame treated before application of the adhesive 60 to improve the bonding strength of the adhesive 60 to the table top 12. The bracket 39 may similarly be coated or otherwise treated to improve the bonding strength of the adhesive 60. The adhesive 60 may be applied by a brush, sprayer, dropper, or any other suitable applicator. Only a matter of seconds is required to apply the adhesive 60 over the channels 80, 82 and gaps 84, 86, 88.

Once the adhesive 60 is applied, it may simply be left to dry for a selected period of time, determined by the type of adhesive 60 used. Since the table 10 is self-fixturing, no other implements need be used to hold the mounting assembly 36 in position. Thus, multiple tables 10 maybe made, stacked in the folded configuration, and prepared for shipment even while the adhesive 60 is setting. The table 10 may even be transported while the adhesive 60 is setting. Engagement of the legs 18 by the securing members 32 ensures that the mounting assemblies 36 will not be dislodged from the fixturing mounts 38 when the table 10 is picked up by a user grasping one of the legs 18 in the folded position 34, even if the adhesive 60 has not finished setting.

Although the tabs 100, 102, 104 and engaging gaps 82, 84, 86 may help fix the bracket 39 in place, as described above, they are not required features of the fixturing mount 38. The first and second abutments 70, 72 may provide sufficient gripping force to retain the bracket 39 against the mounting shelf 26 without the use of additional features. Alternatively, different features may be added to enhance the frictional engagement of the bracket 39 within the fixturing mount 38, or to improve bonding strength of adhesives used.

Figure 5:
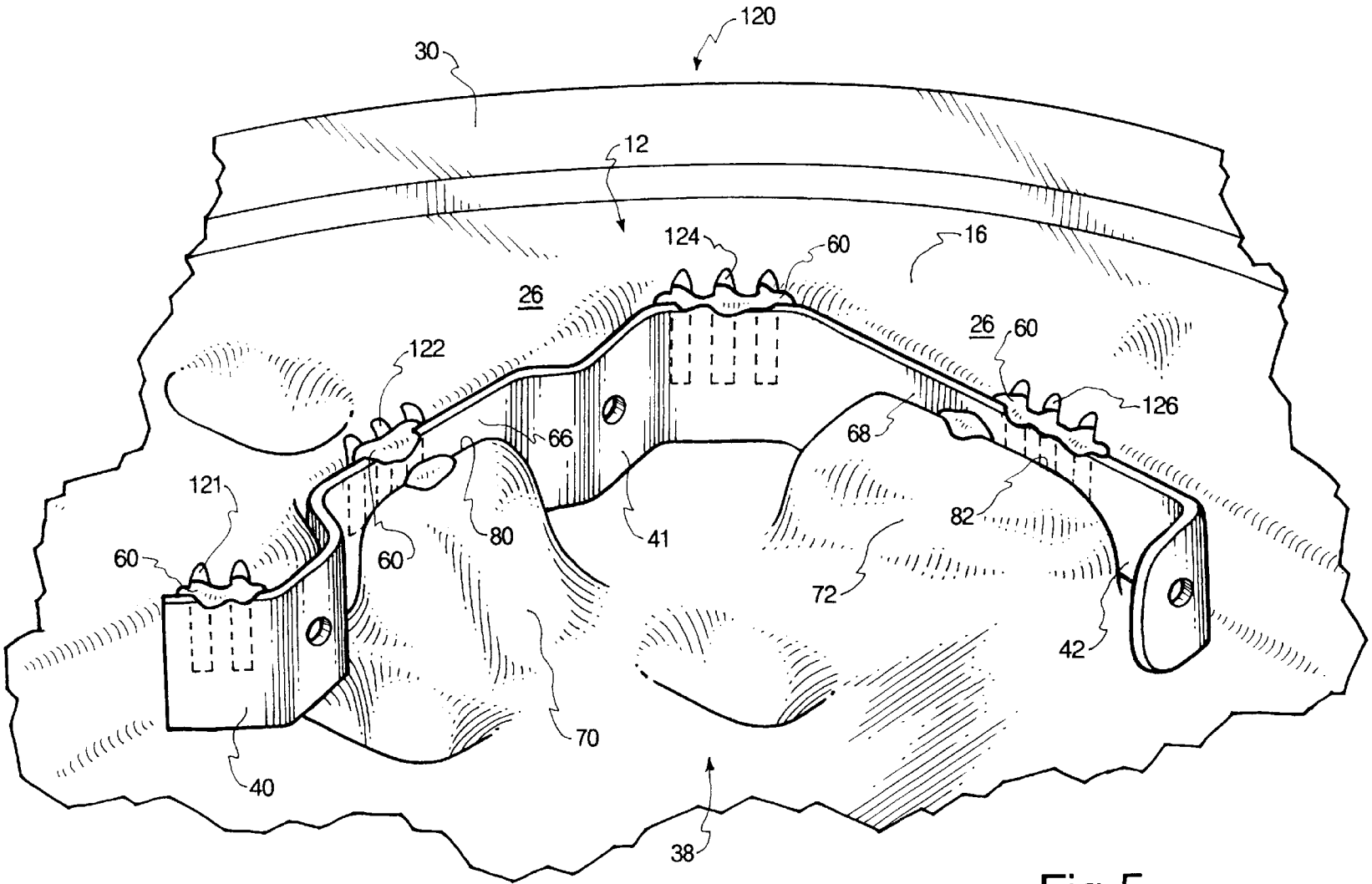
FIG. 5 is an enlarged perspective view of an alternative embodiment of a fixturing mount suitable for the table of FIG. 1, with slots formed in the fixturing mount to receive the adhesive, in place of the tabs and gaps of the embodiment of FIG. 4.

Referring to FIG. 5, an alternative embodiment of a table 120 with a fixturing mount within the scope of the present invention is shown. The bracket 39, the first abutment 70, and the second abutment 72 are all substantially as depicted in FIG. 4. However, for the embodiment of FIG. 5, the recesses 74, 76, 78, the gaps 84, 86, 88, the tabs 100, 102, 104, and the openings 106, 108 have been omitted. The first and second abutments 70, 72 may be dimensioned such that the first and second channels 80, 82 are tight enough to hold the bracket 39 in place without the addition of the tabs 100, 102, 104.

In place of the recesses 74, 76, 78, slots 121, 122, 124, 126 have been formed in the mounting shelf 26 proximate the first end 40, the intermediate portion 41, the second end 42, and between the first end 40 and the intermediate portion 41. The slots 121, 122, 124, 126 may be dimensioned to suit the viscosity of the adhesive 60, so that the adhesive 60 may readily flow into the slots 121, 122, 124, 126. The slots 121, 122, 124, 126 thus effectively provide a channel through which the adhesive 60 may flow to reach the side of the bracket 39. Preferably, the slots 121, 122, 124, 126 are also dimensioned to keep the adhesive from flowing away from the bracket 39 before setting. As a result, a larger bonding surface is created between the mounting shelf 26 and the bracket 39, and the bracket 39 is more tightly attached to the mounting shelf 26.

The slots 121, 122, 124, 126 may be omitted or reconfigured as desired. For example, slots may be formed in the bracket 39, the first abutment 70, the second abutment 72, or some combination thereof, rather than in the mounting shelf 26. Different-shaped openings may be formed in the mounting shelf 26, the abutments 70, 72, or the bracket 39 to accommodate the adhesive 60.

In the alternative, the first and second channels 80, 82 may simply be dimensioned to grip the bracket 39 with less of the adhesive 60, or with no adhesive or other attachment method. If no attachment method is used to attach the mounting assembly 36 to the fixturing mount 38, aside from the frictional engagement of the fixturing protrusions 26, 70, 72 of the fixturing mount 38, the table 10 is not only self-fixturing, but also self-attaching.

The number of steps required for assembly is then reduced to one: the mounting assembly 36 must simply be properly positioned within the fixturing mount 38. The mounting assembly 36 need not be permanently attached by a separate step, and the mounting assembly 36 need not be fixtured for permanent attachment. Thus, configurations in which no adhesive 60 is used may enable the table 120 or the table 10 to be manufactured in the simplest possible way.

Numerous other configurations are possible for the lightweight folding table provided by the present invention. The fixturing mounts 38 maybe located in any number of positions on the mounting surface 16 at which it would be desirable to attach a leg 18. Similarly, any configuration of fixturing protrusions, within and outside the fixturing mounts 38, may be used to effect self-fixturing. Similarly, the mounting assemblies 36 may take any form suitable for assembly with the mounting surfaces 16 of the present invention.

Many of the problems associated with prior art lightweight folding tables are addressed by the teachings of the present invention. From the above discussion, it will be appreciated that the present invention provides a novel lightweight folding table having legs that can be rapidly and easily attached to the table top with a minimum of machinery and personnel. The lightweight folding table may be constructed without a frame, so that each leg may independently be attached directly to the table top.

The present invention also provides novel fixturing mounts and mounting assemblies that may be assembled and permanently attached without a separate fixturing step. The fixturing mounts and mounting assemblies may also be permanently attached together without the use of mechanical fasteners. The present invention also provides novel systems and methods for attaching legs to a table top with an adhesive.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A lightweight folding table, comprising:

a tabletop comprising a working surface and a mounting surface disposed opposite the working surface;

a plurality of legs independently arranged in supportable relation to the tabletop;

a plurality of brackets secured to the mounting surface, each bracket of the plurality of brackets being configured to provide pivotal coupling between a leg of the plurality of legs and the tabletop; and wherein the mounting surface comprises a plurality of fixturing mounts, each of which is configured to receive a bracket from the plurality of brackets during attachment of the bracket to the mounting surface and wherein the fixturing mounts are configured to restrain motion of the brackets in any lateral direction.

2. The lightweight folding table of claim 1, wherein the tabletop is substantially hollow and is constructed of a plastic material formed by blow molding.

3. The lightweight folding table of claim 1, wherein the plurality of legs comprises at least three legs.

4. The lightweight folding table of claim 1, wherein each bracket of the plulraity of brackets are attached to the mounting surface without mechanical fasteners.

5. The lightweight folding table of claim 4, wherein the brackets are attached to the mounting surface by an adhesive applied between the brackets and the mounting surface.

6. The lightweight folding table of claim 5, wherein the fixturing mounts comprise a plurality of slots formed in the fixturing mounts, the slots being configured to receive the adhesive and to hold the adhesive against the brackets.

7. A lightweight folding table, comprising:

a tabletop comprising a working surface and a mounting surface disposed opposite the working surface;

a plurality of legs independently arranged in supportable relation to the tabletop;

a plurality of brackets secured to the mounting surface, each bracket of the plurality of brackets being configured to provide pivotal coupling between a leg of the plurality of legs and the tabletop; and wherein the mounting surface comprises a plurality of fixturing mounts, each of which is configured to receive a bracket from the plurality of brackets during attachment of the bracket to the mounting surface and wherein each of the fixturing mounts comprises a plurality of fixturing protrusions positioned to restrain motion of a bracket from the plurality of brackets in a direction parallel to the table top.

8. The lightweight folding table of claim 7, wherein each bracket is further configured to be slidable in a direction substantially perpendicular to the table top to engage the fixturing protrusions.

9. A lightweight folding table, comprising:

a tabletop comprising a working surface and a mounting surface disposed opposite the working surface;

a plurality of legs independently arranged in supportable relation to the tabletop;

a plurality of brackets secured to the mounting surface, each bracket of the plurality of brackets being configured to provide pivotal coupling between a leg of the plurality of legs and the tabletop; and wherein the mounting surface comprises a plurality of fixturing mounts, each of which is configured to receive a bracket from the plurality of brackets during attachment of the bracket to the mounting surface and wherein each of the fixturing mounts comprises at least a first gap, and wherein each of the brackets comprises at least a first tab protruding from the bracket, the first tab being configured to be engageable within the first gap.

10. A lightweight folding table, comprising:

a tabletop comprising a working surface and a mounting surface disposed opposite the working surface;

a plurality of legs independently arranged in supportable relation to the tabletop;

a plurality of brackets secured to the mounting surface, each bracket being configured to pivotally attach a leg of the plurality of legs to the tabletop; and wherein the mounting surface comprises a plurality of fixturing protrusions configured to restrict lateral motion of the brackets.

11. The lightweight folding table of claim 10, wherein the plurality of fixturing protrusions further comprises a mounting shelf disposed proximate an outer edge of the mounting surface and positioned to restrict motion of each of the plurality of brackets toward the outer edge.

12. The lightweight folding table of claim 11, wherein the plurality of fixturing protrusions further comprises a plurality of abutments positioned proximate the mounting shelf, so as to restrict motion of each of the plurality of brackets away from the outer edge.

13. The lightweight folding table of claim 12, wherein the plurality of fixturing protrusions further comprises a securing member configured to engage one of the plurality of legs in a folded position of the leg, so as to restrain lateral motion of the leg.

14. The lightweight folding table of claim 11, wherein the mounting shelf further comprises at least a first gap corresponding to each bracket, each first gap having a narrow opening, and wherein each bracket comprises at least a first tab protruding from the bracket, the first tab being configured to be frictionally engageable within the narrow opening of the first gap to hold the bracket in place against the mounting shelf.

15. The lightweight folding table of claim 10, wherein each bracket is secured to the mounting surface by an adhesive applied between the bracket and one or more of the plurality of fixturing protrusions.

16. The lightweight folding table of claim 10, wherein the plurality of legs comprises at least three legs.

17. The lightweight folding table of claim 16, wherein the plurality of legs comprises four legs.

18. The lightweight folding table of claim 10, wherein the tabletop is constructed of a plastic material and is formed by blow molding.

19. The lightweight folding table of claim 10, wherein the plurality of brackets are secured to the mounting surface independent of mechanical fasteners.

20. A lightweight folding table comprising:

a tabletop comprising a working surface and a mounting surface disposed opposite the working surface;

a plurality of legs independently arranged in supportable relation to the tabletop;

a plurality of brackets secured to the mounting surface, each bracket being configured to pivotally attach a leg of the plurality of legs to the tabletop; and wherein the brackets are secured to the mounting surface by an adhesive, the adhesive operating without mechanical fasteners, and wherein the mounting surface further comprises a plurality of fixturing mounts integrally formed with the table top, each fixturing mount comprising a fixturing protrusion configured to restrict lateral motion of one of the plurality of brackets with respect to the table top.

21. The lightweight folding table of claim 20, wherein the adhesive is applied between the fixturing protrusion of each fixturing mount and the bracket so as to restrict motion of the bracket in a direction perpendicular to the table top.

22. The lightweight folding table of claim 21, wherein the fixturing protrusion of each fixturing mount comprises a plurality of slots configured to receive the adhesive and hold the adhesive against the bracket.

23. The lightweight folding table of claim 20, wherein the tabletop is constructed of a plastic material and is formed by blow molding.

24. A table comprising:

a blow molded tabletop including a working surface and a mounting surface that are generally spaced apart, the blow molded tabletop including a generally hollow interior;

a first leg that is capable of moving between a collapsed position and an extended position relative to the tabletop;

a second leg that is capable of moving between a collapsed position and an extended position relative to the tabletop;

a first mounting bracket attached to the first leg;

a second mounting bracket attached to the second leg;

a first mounting area integrally formed in the blow molded tabletop as part of a one-piece structure, the first mounting area including one or more protrusions and each protrusion of the one or more protrusions including at least one mounting surface that is sized and configured to help retain the first mounting bracket in a fixed position; and a second mounting area integrally formed in the blow molded tabletop as part of a one-piece structure, the second mounting area including one or more protrusions and each protrusion of the one or more protrusions including at least one mounting surface that is sized and configured to help retain the second mounting bracket in a fixed position.

25. The table of claim 24, wherein the first mounting area includes a generally hollow interior that forms a unitary part of the generally hollow interior of the table top, and the second mounting area includes a generally hollow interior that forms a unitary part of the generally hollow interior of the table top.

26. The table of claim 24, wherein the first leg is pivotally connected to the first mounting bracket and the second leg is pivotally connected to the second mounting bracket.

27. The table of claim 24, further comprising a first channel and a second channel formed in the first mounting area, the first mounting bracket being at least partially disposed within the first channel and the second channel of the first mounting area; and further comprising a first channel and a second channel in the second mounting area, the second mounting bracket being at least partially disposed within the first channel and the second channel of the second mounting area.

28. The table of claim 24, further comprising a first abutment surface and a second abutment surface in the first mounting area, the first mounting bracket being sized and configured to engage at least a portion of the first abutment surface and the second abutment surface in the first mounting area; and further comprising a first abutment surface and a second abutment surface in the second mounting area, the second mounting bracket being sized and configured to engage at least a portion of the first abutment surface and the second abutment surface in the second mounting area.

29. The table of claim 24, further comprising a first end and a second end of the first mounting bracket, the first end and the second end being sized and configured to assist in connecting the first mounting bracket to the first mounting area; and further comprising a first end and a second end of the second mounting bracket, the first end and the second end being sized and configured to assist in connecting the second mounting bracket to the second mounting area.

30. The table of claim 24, further comprising a first tab attached to a first arm of the first mounting bracket and a second tab attached to a second arm of the first mounting bracket, the first tab and second tab of the first mounting bracket being sized and configured to engage one or more surfaces of the first mounting area; and further comprising a first tab attached to a first arm of the second mounting bracket and a second tab attached to a second arm of the second mounting bracket, the first tab and second tab of the second mounting bracket being sized and configured to engage one or more surfaces of the second mounting area.

31. The table of claim 24, further comprising a first support strut connecting the first leg to the first mounting bracket and a second support strut connecting the second leg to the second mounting bracket.

32. The table of claim 24, further comprising a first slotted member connecting the first leg to the first mounting bracket and a second slotted member connecting the second leg to the second mounting bracket.

33. The table of claim 24, further comprising an adhesive that is used to secure the first mounting bracket to the first mounting area and the second mounting bracket to the second mounting area.

34. A table comprising:

a blow molded tabletop including a working surface and a mounting surface that are generally spaced apart;

a mounting assembly integrally formed in the tabletop as part of a one-piece structure, the mounting assembly including one or more outwardly extending protrusions;

a mounting bracket attached to the mounting assembly, the mounting bracket including one or more arms that are sized and configured to contact the one or more outwardly extending protrusions; and a table leg attached to the mounting bracket, the leg being capable of moving between a first position in which the leg is generally positioned adjacent to the mounting surface of the table top and a second position in which the leg extends outwardly from the mounting surface of the tabletop.

35. The table of claim 34, wherein the blow molded tabletop is substantially hollow.

36. The table of claim 34, wherein the mounting bracket is frictionally connected to the mounting assembly in order to secure the leg to the tabletop.

37. The table of claim 34, further comprising a plurality of slots in the mounting assembly that are sized and configured to receive the mounting bracket.

38. The table of claim 34, further comprising a plurality of channels in the mounting assembly, the mounting bracket being at least partially disposed within the plurality of channels.

39. The table of claim 34, further comprising a first tab attached to a first arm of the mounting bracket and a second tab attached to a second arm of the mounting bracket, the first tab and second tab of the mounting bracket being sized and configured to engage one or more engagement surfaces of the mounting assembly.

40. The table of claim 34, further comprising a support strut connecting the leg to the mounting bracket.

41. The table of claim 34, further comprising a slotted member connecting the leg to the mounting bracket.

42. The table of claim 34, further comprising an adhesive that is used to secure the mounting bracket to the mounting assembly.

43. The table of claim 34, further comprising a securing member integrally formed in the mounting surface of the tabletop as part of a one-piece structure, the securing member being sized and configured to frictionally engage and retain the leg in the first position.

44. A table comprising:

a blow molded tabletop including a working surface and a mounting surface that are generally spaced apart;

a mounting assembly integrally formed in the tabletop as part of a one-piece structure, the mounting assembly including one or more channels;

a mounting bracket attached to the mounting assembly, the mounting bracket including one or more arms that are sized and configured to be inserted into the one or more channels in the mounting assembly; and a table leg attached to the mounting bracket, the leg being capable of moving between a first position in which the leg is generally positioned adjacent to the mounting surface of the table top and a second position in which the leg extends outwardly from the mounting surface of the tabletop.

45. The table of claim 44, wherein the blow molded tabletop is substantially hollow.

46. The table of claim 44, wherein the mounting bracket is frictionally connected to the mounting assembly in order to secure the leg to the tabletop.

47. The table of claim 44, further comprising a plurality of protrusions in the mounting assembly that are sized and configured to retain the mounting bracket in a fixed position.

48. The table of claim 44, further comprising a first tab attached to a first arm of the mounting bracket and a second tab attached to a second arm of the mounting bracket, the first tab and second tab of the mounting bracket being sized and configured to engage one or more engagement surfaces of the mounting assembly.

49. The table of claim 44, further comprising a support strut connecting the leg to the mounting bracket.

50. The table of claim 44, further comprising a slotted member connecting the leg to the mounting bracket.

51. The table of claim 44, further comprising an adhesive that is used to secure the mounting bracket to the mounting assembly.

52. The table of claim 44, further comprising a securing member integrally formed in the mounting surface of the tabletop as part of a one-piece structure, the securing member being sized and configured to frictionally engage and retain the leg in the first position.

* * * * *

UNITED STATES PATENT AND TRADEMARK OFFICE

CERTIFICATE OF CORRECTION

PATENT NO. : 6,508,184 B1 
DATED : January 21, 2003
INVENTOR(S) : Preston Winte and L. Curtis Strong It is certified that error appears in the above-identified patent and that said Letters Patent is hereby corrected as shown below:

Title page,
Item [75], Inventors, change "Curtis L." to -- L. Curtis --

Column 2,
Line 44, change "place" to -- placed --

Column 3,
Line 56, change "shelfby" to -- shelf by --
Line 57, change "mayhold" to -- may hold --

Column 5,
Line 1, change "maybe" to -- may be --

Column 7,
Line 20, change "maybe" to -- may be --

Column 10,
Lines 6 and 18, change "maybe" to -- may be --

Column 11,
Line 33, change "maybe" to -- may be --

Column 12,
Line 28, change "plulraity" to -- plurality --

Signed and Sealed this

Fifteenth Day of July, 2003

JAMES E. ROGAN
*Director of the United States Patent and Trademark Office*